US010344784B2

(12) United States Patent
Peterson et al.

(10) Patent No.: US 10,344,784 B2
(45) Date of Patent: Jul. 9, 2019

(54) HYDRAULIC SYSTEM HAVING REGENERATION AND HYBRID START

(71) Applicant: Caterpillar Inc., Peoria, IL (US)

(72) Inventors: Jeremy Todd Peterson, Washington, IL (US); Jeffrey Lee Kuehn, Germantown Hills, IL (US); Michael L. Knussman, Peoria, IL (US); Michael T. Verkuilen, Germantown Hills, IL (US)

(73) Assignee: Caterpillar Inc., Deerfield, IL (US)

( * ) Notice: Subject to any disclaimer, the term of this patent is extended or adjusted under 35 U.S.C. 154(b) by 478 days.

(21) Appl. No.: 14/708,788

(22) Filed: May 11, 2015

(65) Prior Publication Data

US 2016/0333903 A1 Nov. 17, 2016

(51) Int. Cl.
*F15B 21/14* (2006.01)
*F15B 1/02* (2006.01)
(Continued)

(52) U.S. Cl.
CPC ..... *F15B 21/14* (2013.01); *E02F 9/2207* (2013.01); *E02F 9/2217* (2013.01);
(Continued)

(58) Field of Classification Search
CPC ..... E02F 9/2207; E02F 9/2217; E02F 9/2289; E02F 9/2292; E02F 9/2296; F15B 1/024; F15B 1/033; F15B 1/04; F15B 7/006; F15B 13/0401; F15B 21/14; F15B 2201/00; F15B 2211/20523; F15B 2211/20546; F15B 2211/20561; F15B 2211/20569;
(Continued)

(56) References Cited

U.S. PATENT DOCUMENTS 5,179,836 A 1/1993 Dantlgraber
6,732,513 B2 * 5/2004 Tajima ..... E02F 9/2207 60/468
(Continued)

FOREIGN PATENT DOCUMENTS

CN 101341342 1/2009
DE 10 2011 056 894 A1 11/2012
(Continued)

*Primary Examiner* — Michael Leslie
*Assistant Examiner* — Michael Quandt
(74) *Attorney, Agent, or Firm* — Finnegan, Henderson, Farabow, Garrett & Dunner, LLP

(57) ABSTRACT

A hydraulic system is disclosed. The hydraulic system may include a fluid source and an actuator having a first passage and a second passage. The hydraulic system may further include a pump having a first port connected to the first passage, a second port connected to the second passage, and a third port connected to the fluid source. The first and second passages may be connected to each other via the first and second ports, and the first passage and the low-pressure fluid source may be connected to each other via the first and third ports. They hydraulic system may further include a charge circuit fluidly connected to the first and second passages, and at least one damping control valve configured to selectively allow fluid from the pump to pass into the charge circuit to dampen pressure oscillations between the actuator and the pump.

12 Claims, 6 Drawing Sheets

(51) Int. Cl.

| | |
|---|---|
| ***F15B 1/033*** | (2006.01) |
| ***F15B 7/00*** | (2006.01) |
| ***E02F 9/22*** | (2006.01) |

(52) U.S. Cl.

CPC ..... *E02F 9/2289* (2013.01); *E02F 9/2292* (2013.01); *E02F 9/2296* (2013.01); *F15B 1/024* (2013.01); *F15B 1/033* (2013.01); *F15B 7/006* (2013.01); *F15B 2211/20523* (2013.01); *F15B 2211/20546* (2013.01); *F15B 2211/20561* (2013.01); *F15B 2211/20569* (2013.01); *F15B 2211/20576* (2013.01); *F15B 2211/27* (2013.01); *F15B 2211/30515* (2013.01); *F15B 2211/613* (2013.01); *F15B 2211/625* (2013.01); *F15B 2211/6346* (2013.01); *F15B 2211/6652* (2013.01); *F15B 2211/785* (2013.01); *F15B 2211/851* (2013.01); *F15B 2211/8613* (2013.01)

(58) Field of Classification Search

CPC ..... F15B 2211/20576; F15B 2211/27; F15B 2211/30515; F15B 2211/613; F15B 2211/625; F15B 2211/6346; F15B 2211/6652; F15B 2211/785; F15B 2211/851; F15B 2211/8613; F15B 2211/50563

See application file for complete search history.

(56) References Cited

U.S. PATENT DOCUMENTS

| | | | | |
|---|---|---|---|---|
| 6,912,849 | B2 | 7/2005 | Inoue et al. | |
| 6,962,050 | B2 | 11/2005 | Hiraki et al. | |
| 7,578,127 | B2 | 8/2009 | Griswold | |
| 7,784,278 | B2 | 8/2010 | Jacobs et al. | |
| 8,033,107 | B2 * | 10/2011 | Tikkanen | F15B 7/006 60/464 |
| 8,381,516 | B2 | 2/2013 | Grossart | |
| 8,944,103 | B2 * | 2/2015 | Opdenbosch | E02F 9/2217 137/596.14 |
| 9,080,310 | B2 * | 7/2015 | Knussman | E02F 9/2235 |
| 2013/0048117 | A1 | 2/2013 | Opdenbosch et al. | |
| 2013/0098464 | A1 | 4/2013 | Knussman | |
| 2013/0333894 | A1 | 12/2013 | Geiger et al. | |
| 2014/0033698 | A1 * | 2/2014 | Opdenbosch | F15B 7/006 60/422 |

FOREIGN PATENT DOCUMENTS

| | | | |
|---|---|---|---|
| JP | 62-4903 | A | 1/1987 |
| WO | WO 2005/028879 | A1 | 3/2005 |
| WO | WO 2009/125505 | A1 | 10/2009 |

* cited by examiner

HYDRAULIC SYSTEM HAVING REGENERATION AND HYBRID START

TECHNICAL FIELD

The present disclosure relates generally to a hydraulic system and, more particularly, to a meterless hydraulic system having a pump with divided displacement.

BACKGROUND

A conventional hydraulic system includes a pump that draws low-pressure fluid from a tank, pressurizes the fluid, and makes the pressurized fluid available to multiple different actuators for use in moving the actuators. In this arrangement, a speed and/or force of each actuator can be independently controlled by selectively throttling (i.e., restricting) a flow of the pressurized fluid from the pump into and/or out of each actuator. An alternative type of hydraulic system is known as a meterless hydraulic system, which generally includes a pump connected in closed-loop fashion to one or more actuators. During operation, the pump draws fluid from one chamber of the actuator(s) and discharges pressurized fluid to an opposing chamber of the same actuator(s). To move the actuator(s) at a higher speed, the pump discharges fluid at a faster rate. A common type of actuator is a double-acting cylinder having a single rod that moves a piston between a "rod end" of the cylinder that is opposite a "head end" of the cylinder.

One problem with meterless hydraulic systems involves passing fluid between the head end and rod end of a double-acting cylinder. Because the volume of the rod end is reduced by the volume of the rod, the head and rod ends consume and discharge different volumes of fluid for a given movement of the cylinder, which can lead to starving or stalling of the pump. Also, when an associated load of a work tool attached to the cylinder suddenly changes directions, the pump displacement must be adjusted to avoid creating velocity discontinuities of the cylinder movement, which can cause the system to operate in a jerky manner. Further, unintended movements (e.g., bouncing) of the associated load of the work tool may create fluid pressure oscillations that can travel back to the pump in a meterless system. These oscillations may also cause the pump to behave in a jerky manner.

One attempt to accommodate a difference between the head end volume and the rod end volume of a hydraulic cylinder is described in U.S. Pat. No. 6,912,849 B2 (the '849 patent) that issued to Inoue et al. on Jul. 5, 2005. In the '849 patent, a closed-loop hydraulic system is described. The hydraulic system includes a pump that has a first port connected to the head end of a hydraulic cylinder, a second port connected to the rod end of the hydraulic cylinder, and a third port connected to a tank. The pump is driven by an electric motor, which controls the speed, direction, and discharge rate of the pump. When rotated in a first direction, fluid from the head end of the cylinder is drawn into the pump, apportioned, and expelled to the rod end of the cylinder and to the tank. When rotated in the opposite direction, fluid from the rod end and from the tank is drawn into the pump, combined, and expelled to the head end of the cylinder. When braking is applied to slow the pump, energy is recovered as electricity by the electric motor.

Although somewhat effective at accommodating the difference between head end and rod end volumes of a hydraulic cylinder, the system of the '894 patent may not be optimum. Specifically, the '894 system may still operate in an overly jerky manner, which may result in a shortened lifespan of the pump and discomfort to the operator of an associated machine. Further, the pump of the '894 system may be large and therefore less efficient. The '894 system may also experience pressure losses during retraction strokes when fluid from the head is directed to the tank, thereby further reducing the system's efficiency.

The hydraulic system of the present disclosure is directed toward solving one or more of the problems set forth, above and/or other problems of the prior art.

SUMMARY

In one aspect, the present disclosure is directed to a hydraulic system. The hydraulic system may include a fluid source and an actuator having a first passage and a second passage. The hydraulic system may further include a pump having a first port connected to the first passage, a second port connected to the second passage, and a third port connected to the low-pressure fluid source. The first and second passages may be connected to each other via the first and second ports, and the first passage and the fluid source may be connected to each other via the first and third ports. They hydraulic system may further include a charge circuit fluidly connected to the first and second passages, and at least one damping control valve configured to selectively allow fluid from the pump to pass into the charge circuit to dampen pressure oscillations between the actuator and the pump.

In another aspect, the present disclosure is directed to a method of operating a hydraulic system. The method may include receiving a signal indicative of a desire to move a work tool via an actuator, and drawing fluid into a pump from at least one of a first passage fluidly connected to the actuator, a second passage fluidly connected to the actuator, and a fluid source, and discharging pressurized fluid from the pump into at least one of the other of the first and second passages and the fluid source to move the actuator based on the signal. The method may further include selectively directing pressurized fluid from the pump to a charge circuit to dampen fluid pressure oscillations between the pump and the actuator.

In yet another aspect, the present disclosure is directed to a hydraulic system. The hydraulic system may include an accumulator, an actuator having a first passage and a second passage, and a pump having a first port connected to the first passage, a second port connected to the second passage, and a third port connected to the accumulator. The first and second passages may be connected to each other via the first and second ports, and the first passage and the low-pressure fluid source may be connected to each other via the first and third ports. The hydraulic system may further include a charge circuit fluidly connected to the first and second passages, at least one damping control valve configured to selectively allow fluid from the pump to pass into the charge circuit to dampen pressure oscillations between the actuator and the pump, and a regeneration control valve configured to selectively allow fluid expelled from the actuator into the first passage to bypass the pump and flow into the second passage when the actuator is retracted. The hydraulic system may further include a discharge valve fluidly connected between the pump and the accumulator.

DETAILED DESCRIPTION

Figure 1:
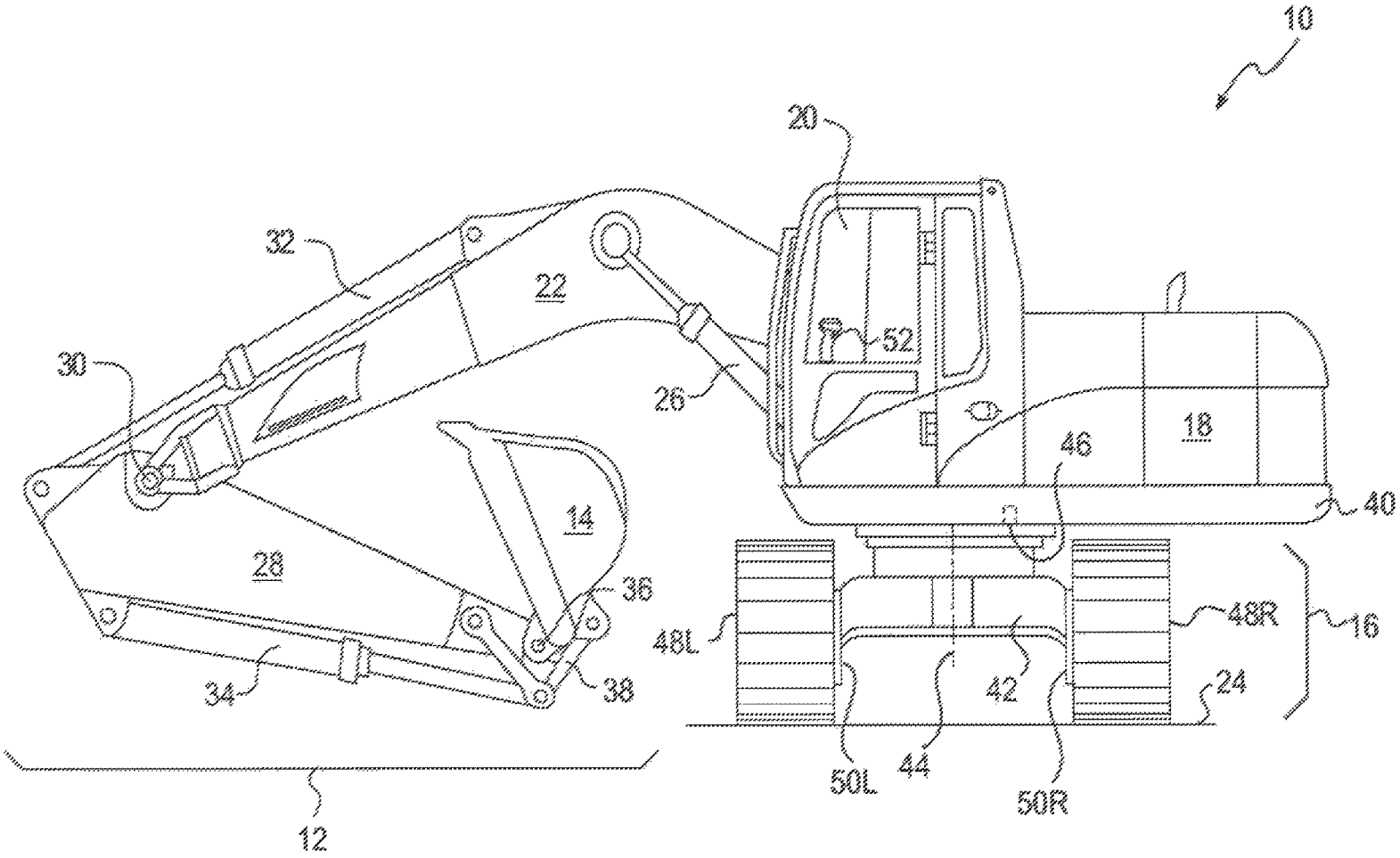
FIG. 1 is a pictorial illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be an earth moving machine such as the excavator shown in FIG. 1, a dozer, a loader, a backhoe, a motor grader, a dump truck, or any other earth moving machine. Machine 10 may include an implement system 12 configured to move a work tool 14, a drive system 16 for propelling machine 10, a power source 18 that provides power to implement system 12 and drive system 16, and an operator station 20 situated for manual control of implement system 12, drive system 16, and/or power source 18.

Implement system 12 may include a linkage structure acted on by fluid actuators to move work tool 14. In the disclosed exemplary embodiment, implement system 12 includes a boom 22 that is vertically pivotal about a horizontal axis (not shown) relative to a work surface 24 by a pair of adjacent, double-acting, hydraulic cylinders 26 (only one shown in FIG. 1). Implement system 12 also includes a stick 28 that is vertically pivotal about a horizontal axis 30 by a single, double-acting, hydraulic cylinder 32, and a single, double-acting, hydraulic cylinder 34 that is operatively connected between stick 28 and work tool 14 to pivot work tool 14 vertically about a horizontal pivot axis 36. Hydraulic cylinder 34 is connected to work tool 14 by way of a power link 38. Boom 22 is pivotally connected to a body 40 of machine 10, and body 40 is pivotally connected to an undercarriage 42 and movable about a vertical axis 44 by a hydraulic swing motor 46. Stick 28 may pivotally connect boom 22 to work tool 14 by way of axes 30 and 36. It is contemplated that implement system 12 may be arranged differently, if desired.

Numerous different work tools 14 may be attachable to a single machine 10 and operator controllable. Work tool 14 may include any device used to perform a particular task such as, for example, a bucket (shown in FIG. 1), a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot in the vertical direction relative to body 40 of machine 10 and to swing in the horizontal direction, work tool 14 may alternatively or additionally rotate, slide, open and close, or move in any other manner known in the art.

Drive system 16 may include one or more traction devices powered to propel machine 10. In the disclosed example, drive system 16 includes a left track 48L located at one side of machine 10, and a right track 48R located at an opposing side of machine 10. Left track 48L may be driven by a left travel motor 50L, while right track 48R may be driven by a right travel motor 50R. It is contemplated that drive system 16 could alternatively include traction devices other than tracks, such as wheels, belts, or other known traction devices. Machine 10 may be steered by generating a speed and/or rotational direction difference between left and right travel motors 50L, 50R, while straight travel may be facilitated by generating substantially equal output speeds and rotational directions from left and right travel motors 50L, 50R.

Power source 18 may embody an engine such as, for example, a diesel engine, a gasoline engine, a gaseous fuel-powered engine, or any other type of combustion engine known in the art. It is contemplated that, in some applications, power source 18 may alternatively embody a non-combustion source of power such as a fuel cell, a power storage device, or another source known in the art. Power source 18 may produce a mechanical or electrical power output that may then be converted to hydraulic power for moving hydraulic cylinders 26, 32, 34, left and right travel motors 50L, 50R, and/or swing motor 46.

Operator station 20 may include devices that receive input from a machine operator indicative of desired machine maneuvering. Specifically, operator station 20 may include one or more input device(s) 52, for example a joystick, a steering wheel, and/or a pedal, that are located proximate an operator seat (not shown). Input device 52 may initiate movement of machine 10, for example travel and/or tool movement, by producing displacement signals that are indicative of desired machine maneuvering. Input device 52 may be movable from a minimum displacement position through a range to a maximum displacement position. Signals generated by input device 52 may correspond to movement parameters (e.g., speed, force, direction etc.) that vary over the range of displacement according to a linear, curvilinear, or other relationship. Accordingly, as an operator moves input device 52, the operator may affect a corresponding machine movement in a desired direction, with a desired speed, and/or with a desired force based on the amount of displacement of input device 52.

Figure 2:
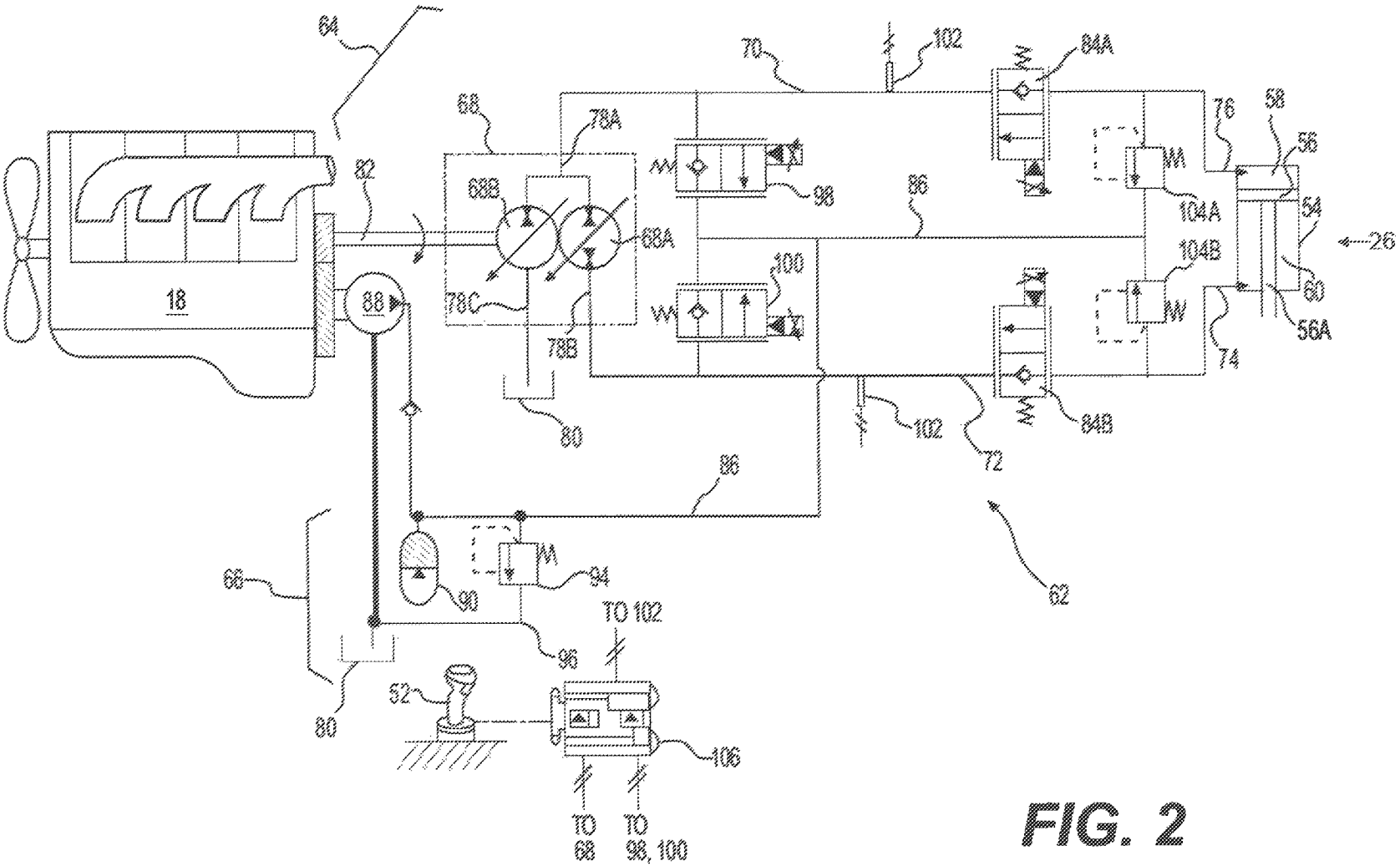
FIGS. 2-6 are schematic illustrations of exemplary disclosed hydraulic systems that may be used in conjunction with the machine of FIG. 1.

One exemplary linear actuator (one of hydraulic cylinders 26) is shown in the schematic of FIG. 2. It should be noted that, while a specific linear actuator is shown, the depicted actuator may represent any one or more of the linear actuators (e.g., hydraulic cylinders 26, 32, 34) or the rotary actuators (left travel, right travel, or swing motors 50L, 50R, 46) of machine 10.

As shown schematically in FIG. 2, hydraulic cylinder 26 may comprise any type of linear actuator known in the art. Hydraulic cylinder 26 may include a tube 54, and a piston assembly 56 arranged within tube 54 to form a first chamber 58 and an opposing second chamber 60. In one example, a rod portion 56A of piston assembly 56 may extend through an end of second chamber 60. As such, second chamber 60 may be considered the rod-end chamber of hydraulic cylinders 26 and 34, while first chamber 58 may be considered the head-end chamber.

First and second chambers 58, 60 may each be selectively provided with pressurized fluid and drained of the pressurized fluid to cause piston assembly 56 to move within tube 54, thereby changing an effective length of hydraulic cylinder 26 and moving work tool 14 (referring to FIG. 1). A flow rate of fluid into and out of first and second chambers 58, 60 may relate to a translational velocity of hydraulic cylinder 26, while a pressure differential between first and second chambers 58, 60 may relate to a force imparted by hydraulic cylinder 26 on the associated linkage structure of implement system 12. It should be noted that, although hydraulic cylinders 32 and 34 are not shown in FIG. 2, their structure and operation may be similar to that described above with respect to hydraulic cylinder 26.

The force imparted on hydraulic cylinder 26 due to the pressure differential therein may move piston assembly 56 toward the head-end or the rod-end, depending on the direction of travel of hydraulic cylinder 26. The force may act on a head-end area $A_{HE}$ in first chamber 58, and on a rod-end area $A_{RE}$ in second chamber 60. Because rod portion 56A is attached to piston assembly 56 in second chamber 60 only, the rod-end area $A_{RE}$ may be reduced by an amount equal to an area AR of rod portion 56A. In some embodiments, the total area of piston assembly 56 in first chamber 58 may equal the total area in second chamber 60. That is, the head-end area $A_{HE}$ may equal the rod-end area $A_{RE}$ plus the rod area $A_R$ (i.e., $A_{HE}=A_{RE}+A_R$). Similarly, a head-end volume $V_{HE}$ may be equal to a rod-end volume $V_{RE}$ plus a volume $V_R$ of rod portion 56A. Thus, for a given of movement piston assembly 56, an amount of fluid entering or exiting first chamber 58 may be different than an amount of fluid entering or exiting second chamber 60 of cylinder 26. The ratio R of the amount of fluid entering or exiting first chamber 58 to the amount of fluid entering or exiting second chamber 60 may be related to the head-end area $A_{HE}$, rod-end area $A_{RE}$, and rod area $A_R$ as shown in equations EQ1-EQ3 below.

$$R=A_{HE}/A_{RE} \quad \text{EQ1}$$

$$A_{HE}=A_{RE}+A_R \quad \text{EQ2}$$

$$A_R/A_{RE}=R-1 \quad \text{EQ3}$$

Left travel, right travel, and swing motors 50L, 50R, 46 (referring to FIG. 1), like hydraulic cylinder 26, may be driven by a fluid pressure differential. Specifically, each of these motors may include first and second chambers (not shown) located to either side of a pumping mechanism, such as an impeller, plunger, or series of pistons (not shown). When the first chamber is filled with pressurized fluid and the second chamber is drained of fluid, the pumping mechanism may be urged to move or rotate in a first direction. Conversely, when the first chamber is drained of fluid and the second chamber is filled with pressurized fluid, the pumping mechanism may be urged to move or rotate in an opposite direction. The flow rate of fluid into and out of the first and second chambers may determine a rotational velocity of the corresponding motor, while a pressure differential across the pumping mechanism may determine an output torque. It is contemplated that a displacement of left travel motor 50L, right travel motor 50R, and/or swing motor 46 may be variable, if desired, such that for a given flow rate and/or pressure of supplied fluid, a rotational speed and/or output torque of the motor may be adjusted.

As illustrated in FIG. 2, machine 10 may include a hydraulic system 62 having a plurality of fluid components that cooperate to move work tool 14 and machine 10 via hydraulic cylinder 26. In particular, hydraulic system 62 may include, among other things, a tool circuit 64 and a charge circuit 66. Tool circuit 64 may be a boom circuit associated with hydraulic cylinder 26. Charge circuit 66 may be selectively fluidly connected with tool circuit 64 to receive excess fluid from tool circuit 64 and/or to provide makeup fluid to tool circuit 64, as necessary. It is contemplated that additional and/or different configurations of circuits may be included within hydraulic system 62 such as, for example, a bucket (not shown) circuit associated with hydraulic cylinder 34, swing motor 46; a stick circuit (not shown) associated with hydraulic cylinder 32, left travel motor 50L, and right travel motor 50R; or an independent circuit associated with each separate actuator (e.g., with each of hydraulic cylinders 32, 34, 26, left travel motor 50L, right travel motor 50R, and/or swing motor 46), if desired. In addition, in exemplary embodiments, one or more of the circuits of hydraulic system 62 may be meterless circuits.

In the disclosed embodiment, tool circuit 64 includes a plurality of interconnecting and cooperating fluid components that facilitate independent use and control of hydraulic cylinder 26. For example, tool circuit 64 may include a pump 68 that is fluidly connected to hydraulic cylinder 26 via a closed-loop formed by a first pump passage 70, a second pump passage 72. First pump passage 70 may include a head-end passage 76 portion connected at the head-end of cylinder 26, and second pump passage 72 may include a rod-end passage 74 portion connected at the rod-end of cylinder 26. To cause hydraulic cylinder 26 to extend, head-end passage 76 may be filled with fluid pressurized by pump 68 (via first or second pump passages 70, 72, depending on a rotational direction of the displacement controller or stroke-adjusting mechanism associated with pump 68), while rod-end passage 74 may be filled with fluid returning from hydraulic cylinder 26 (via the other of first or second pump passages 70, 72). In contrast, during a retracting operation, rod-end passage 74 may be filled with fluid pressurized by pump 68, while head-end passage 76 may be filled with fluid returning from hydraulic cylinder 26. First and second pump passages 70, 72 may be fluidly connected to exchange fluid (e.g., excess fluid and/or makeup fluid) with charge circuit 66 during extending and retraction operations of cylinder 26.

Pump 68 may be a variable displacement, overcenter-type pump. That is, pump 68 may be controlled to draw fluid (e.g., low-pressure fluid) from hydraulic cylinder 26 via one of first and second pump passages 70, 72 and to discharge the fluid at a specified elevated pressure through a range of flow rates back to hydraulic cylinder 26 via the other of first and second pump passages 70, 72. For this purpose, pump 68 may include a displacement controller, such as a swashplate and/or other like stroke-adjusting mechanism. The position of various components of the displacement controller may be electro-hydraulically and/or hydro-mechanically adjusted based on, among other things, a flow rate demand, a desired speed, a desired torque, and/or a load of hydraulic cylinder 26 to thereby change a displacement (e.g., a discharge rate and/or pressure) of pump 68. The displacement of pump 68 may be varied from a zero displacement position at which substantially no fluid is discharged from pump 68, to a maximum displacement position in a first direction at which fluid is discharged from pump 68 at a maximum rate and/or pressure into first pump passage 70. Likewise, the displacement of pump 68 may be varied from the zero displacement position to a maximum displacement position in a second direction at which fluid is discharged from pump 68 at a maximum rate and/or pressure into second pump passage 72. Pump 68 may be drivably connected to power source 18 of machine 10 by, for example, a countershaft, a belt, or in another suitable manner. Alternatively, pump 68 may be indirectly connected to power source 18 via a torque converter, a gear box, an electrical circuit, or in any other manner known in the art. It is contemplated that pump 68 may alternatively be a nonovercenter (i.e., unidirectional), if desired, when power source 18 is a bi-directional and variable speed power source.

Pump 68 may also be selectively operated as a motor. More specifically, when hydraulic cylinder 26 is operating in an overrunning condition, the fluid discharged from hydraulic cylinder 26 may have a pressure elevated higher than an output pressure of pump 68. In this situation, the elevated pressure of the actuator fluid directed back through pump 68 may function to drive pump 68 to rotate with or without assistance from power source 18. Under some circumstances, pump 68 may even be capable of imparting energy to power source 18, thereby improving an efficiency and/or capacity of power source 18.

Pump 68 may have three ports 78*a*, 78*b*, 78*c*. For example, pump 68 may include a first port 78*a* connected to first passage 70, a second port 78*b* connected to second passage 72, and a third port 78*c* connected to a low-pressure fluid source 80. Pump 68 may be configured to pump fluid between first and second passages 70, 72 via first and second ports 78*a*, 78*b*. That is, first and second passages 70, 72 may be fluidly connected through pump 68 via one or more internal passages and first and second ports 78*a*, 78*b*. Pump 68 may be further configured to pump fluid between first passage 70 and low-pressure fluid source 80 via first and third ports 78*a*, 78*c*. That is, first passage 70 and low-pressure fluid source 80 may be fluidly connected through pump 68 via one or more internal passages connecting first and third ports 78*a*, 78*c*. First and second ports 78*a*, 78*b* may be connected through pump 68 via separate internal passages from internal passages connecting first and third ports 78*a*, 78*c*. In this way, first port 78*a* may be a common port that connects separately to second and third ports 78*b*, 78*c*.

Figure 6:
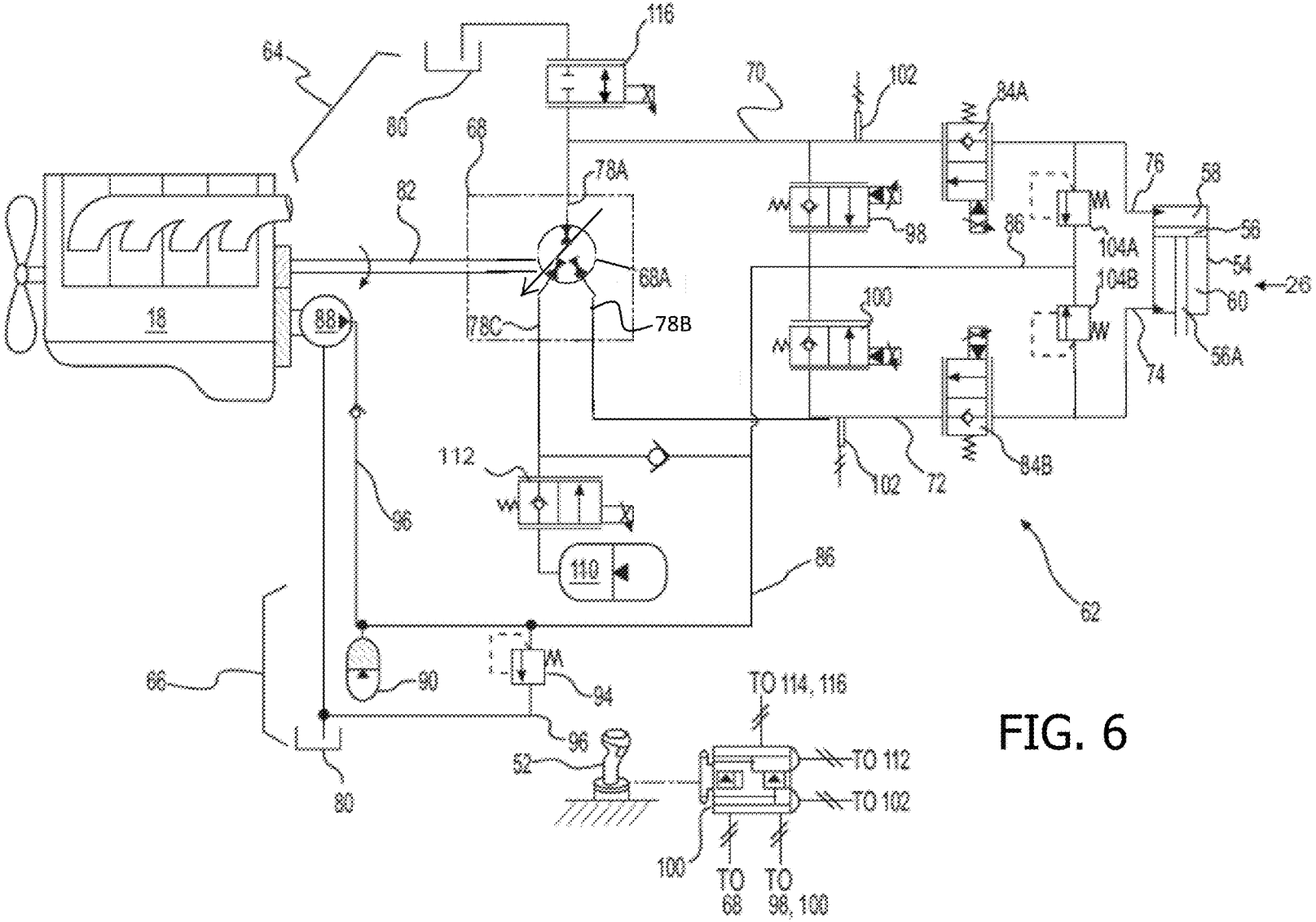

Pump 68 may include one or more pumping elements 68*a*, 68*b* drivingly connected to a common drive shaft 82. Pumping elements 68*a*, 68*b* may each have stroke adjusting mechanisms (e.g., a swashplate) that are configured to be adjusted in proportion to each other. In other embodiments, pumping elements 68*a*, 68*b* may be driven on separate driveshafts, and/or have independently variable stroke adjusting mechanisms, if desired. In the configuration shown in FIG. 2, first port 78*a* may be common to a first side of each pumping element 68*a*, 68*b*. First and second ports 78*a*, 78*b* may be connected to each other through pumping element 68*a*, while first and third ports 78*a*, 78*c* may be separately connected to each other through pumping element 68*b*. It should be noted that in other embodiments, pump 68 may alternatively include a single pumping element 68A (e.g., a single variable displacement pump) having three ports, if desired, such as shown in FIG. 6.

The displacement of pump 68 may be divided between pumping elements 68*a*, 68*b*. The ratio of displacements 68*a* to 68*b* may be equal to the ratio of the rod-end area $A_{RE}$ to the area of the rod $A_R$. When these areas are equal, the displacements of pumping elements 68*a* and 68*b* may also be equal. When these areas are different, the displacements of pumping elements 68*a*, 68*b* may be unequal in order to accommodate the difference in the amount of fluid entering or exiting first chamber 58 and the amount of fluid entering or exiting second chamber 60 during movements of hydraulic cylinder 26. That is, the displacements of pumping elements 68*a*, 68*b* (or the sizes of ports 78*a-c* for a single pumping element) may be separate and unequal to allow pump 68 to draw a larger amount of fluid from first pump passage 70 via port 78*a*, and to discharge a smaller second amount of fluid to second pump passage 72 via port 78*b*. The remaining fluid (i.e., the difference between the larger and smaller amounts) may be drawn or discharged through third port 78*c*, as needed. For example, pumping element 68*a* may have a first displacement, pumping element 68*b* may have a second displacement, and one of the first and second displacements may be larger than the other of the first and second displacements. In this way, the difference between the volumes of first and second chambers 58, 60 may be accommodated efficiently and without a need to adjust the displacement of pump 68.

In one embodiment, first pumping element 68*a* may have a displacement $D_{RE}$, and second pumping element 68*b* may have a displacement $D_R$. $D_{RE}$ may be sized to accommodate the rod-end volume $V_{RE}$, and $D_R$ may be sized to accommodate the rod volume $V_R$. $V_{RE}$ and $V_R$ may be proportional to $A_{RE}$ and $A_R$, respectively, and thus the ratio of $V_R$ to $V_{RE}$ may be equal to the ratio R−1. Thus, the ratio of $D_R$ to $D_R$ may also be equal to the ratio R−1 in order for pumping elements 68*a* and 68*b* to efficiently accommodate $V_{RE}$ and $V_R$, respectively.

Hydraulic system 62 may be provided with one or more load-holding valves 84 that are configured to maintain a position of hydraulic cylinder 26 when no movement thereof has been requested. Load-holding valves 84*a*, 84*b* may embody, for example, two-position, two-way, proportional solenoid-operated control valves. Each load-holding valve 84*a*, 84*b* may be moveable from a first position (shown in FIG. 2) at which fluid may flow only in one direction into the rod- or head-end passage 74, 76 based on a pressure differential across load-holding valve 84*a*, 84*b*, to a second position at which fluid may freely flow in either direction between the corresponding first or second pump passage 70, 72 and the corresponding rod- or head-end passage 74, 76. Load-holding valves 84*a*, 84*b* may be spring-biased to their first positions (i.e., load-holding valves 84*a*, 84*b* may normally be in the first positions). When loading-holding valves 84*a*, 84*b* are in their first positions, fluid may be inhibited from leaving hydraulic cylinder 26 through load-holding valves 84*a*, 84*b*, thereby locking hydraulic cylinder 26 in a particular actuated position.

Charge circuit 66 may include at least one hydraulic source fluidly connected to a common passage 86 fluidly connecting first and second pump passages 70, 72. In the disclosed embodiment, charge circuit 66 has two sources, including a charge pump 88 and a charge accumulator 90, which are fluidly connected to common passage 86 in parallel to provide makeup fluid to tool circuit 64. Charge pump 88 may embody, for example, an engine-driven, fixed or variable displacement pump configured to draw fluid from a tank 80, pressurize the fluid, and discharge the fluid into common passage 86. Charge accumulator 90 may embody, for example, a compressed gas, membrane/spring, or bladder type of accumulator configured to accumulate pressurized fluid from and discharge pressurized fluid into common passage 86. Excess hydraulic fluid, either from charge pump 88 or from tool circuit 64 from operation of pump 68 and/or hydraulic cylinder 26) may be directed into either charge accumulator 90, or into tank 80 by way of a charge relief valve 94 disposed in a return passage 96. Charge relief valve 94 may be movable from a flow-blocking position toward a flow-passing position as a result of elevated fluid pressures within common passage 86 relative to return passage 96.

Hydraulic system 62 may further be provided with one or more control valves for damping pressure oscillations in first and second pump passages 70, 72. For example, hydraulic system 62 may include damping control valves 98 and 100 that are configured to selectively allow fluid from pump 68 to pass into the charge circuit 66 to dampen pressure oscillations between hydraulic cylinder 26 and pump 68. Damping control valves 98, 100 may be solenoid-operated, proportional control valves that are spring-biased to a first position and movable to a second position. In the first position, damping control valves 98, 100 may serve as check valves to prevent flow into charge circuit 66 and to allow makeup flow from charge circuit to pass into first or second passage 70, 72 depending on the pressure. In the second position, damping control valves 98, 100 may include a variable restrictive orifice that is selectively adjustable between a closed position and an open position to dampen pressure oscillations in first and second pump passages 70, 72. It is understood that the functionality of control valves 98, 100 may alternatively be performed using one or more other types of valves, such as for example, a combination of one or more pilot operated check valves and a single solenoid-operated control valve, if desired.

When pressurized with fluid from pump 68, first and second pump passages 70, 72 may become stiff and transmit pressure oscillations from hydraulic cylinder 26 to pump 68, causing a jerking reaction. Such pressure oscillations may occur, for example, when work tool 14 is suddenly stopped (e.g., encounters an obstruction) or bounces as machine 10 is driven over uneven terrain. These pressure oscillations may be damped by opening the restrictive orifice in damping control valves 98, 100 to allow some fluid to squeeze through the orifice, thereby relieving the pressure in first and second passages 70, 72.

Damping control valves 98, 100 may be configured to increase the damping effect by increasing the size of their associated orifice based on the pressure in first and second pump passages 70, 72. For example, when the pressure between hydraulic cylinder 26 and pump 68 increases, the associated orifice within damping control valves 98, 100 may open wider to allow more fluid to squeeze through the orifice into charge circuit 66 to dampen the pressure oscillations. Conversely, when the pressure in first and second passages 70, 72 decreases, the orifice within damping control valves 98, 100 may open less to allow less fluid to squeeze through the orifice into charge circuit 66. Pressure sensors 102 may be positioned in first and second pump passages 70, 72 between pump 68 and load-holding valves 84*a*, 84*b*, respectively, and configured to generate a pressure signal for controlling damping control valves 98, 100.

Damping control valves 98, 100 may also be modulated to help regulate a speed and/or force of work tool 14 imparted by hydraulic cylinder 26. That is, the associated restrictive orifice within damping control valves 98, 100 may be adjusted to selectively direct fluid discharged from pump 68 into charge circuit 66 via common passage 86 to limit the fluid pressure in first and second pump passages 70, 72 in response to the signal from input device 52. For example, as an operator of machine 10 displaces input device 52, damping control valves 98, 100 may adjust their associated restrictive orifice to limit the fluid pressure within first or second pump passage 70, 72 based on a desired pressure limit that is based on the signal generated by input device 52.

In one embodiment, damping control valves 98, 100 may be in the first check valve position when input device 52 is in a neutral position (i.e., when the operator is not giving a command to move work tool 14). Smaller displacements of input device 52 from the neutral position (e.g., when a command for a low output force of cylinder 26 is generated) may generate signals to move damping control valves 98, 100 to the second position and to widen the associated orifice, which may correspond to lower desired pressure limits and lower force limits on cylinder 26. As displacements of input device 52 are made larger (e.g., when a command for the output force of cylinder 26 is raised), input device 52 may generate signals to decrease the size of the associated orifice within damping control valves 98, 100, which may correspond to higher pressure limits and higher force limits on cylinder 26. It is contemplated, however, that damping control valves 98, 100 may be in their second position and their associated orifice may be fully open when input device 52 is in the neutral position, if desired.

Hydraulic system 62 may further include two pressure relief valves 104*a*, 104*b* that are fluidly connected between first and second pump passages 70, 72 and common passage 86 to relieve first and second pump passages 70, 72 from sudden pressure increases. Pressure relief valves 104*a*, 104*b* may be spring-biased, pilot controlled valves, and configured to selectively divert fluid discharged from pump 68 to charge circuit 66 when the fluid pressure elevated by pump 68 exceeds a pressure relief threshold. For example, when cylinder 26 suddenly encounters a physical obstruction, the fluid pressure within first and/or second pump passages 70, 72 may suddenly rise before the output of pump 68 is reduced (e.g., before pump 68 can be de-stroked) and force open pressure relief valve 104*a*, 104*b* to limit the pressure within pump passages 70, 72. In other embodiments, pressure relief valves 104*a*, 104*b* may be solenoid-operated and/or have variable pressure relief thresholds, if desired.

During operation of machine 10, the signals generated by input device 52 may be provided to a controller 106. Signals generated by the operator via input device 52 may identify desired movements of other various linear and/or rotary actuators of machine 10 in addition to those of cylinder 26. Based upon one or more signals, including the signals from input device 52, pressure sensors 102, and/or various other pressure and/or position sensors (not shown) located throughout hydraulic system 62, controller 106 may command movement of the different valves and/or displacement changes of the different pumps and motors to advance a particular one or more of the linear and/or rotary actuators to a desired position in a desired manner (i.e., at a desired speed and/or with a desired force).

Controller 106 may embody a single microprocessor or multiple microprocessors that include components for controlling operations of hydraulic system 62 based on input from an operator of machine 10 and based on sensed or other known operational parameters. Numerous commercially available microprocessors can be configured to perform the functions of controller 106. It should be appreciated that controller 106 could readily be embodied in a general machine microprocessor capable of controlling numerous machine functions. Controller 106 may include a memory, a secondary storage device, a processor, and any other components for running an application. Various other circuits may be associated with controller 106 such as power supply circuitry, signal conditioning circuitry, solenoid driver circuitry, and other types of circuitry.

Figure 3:
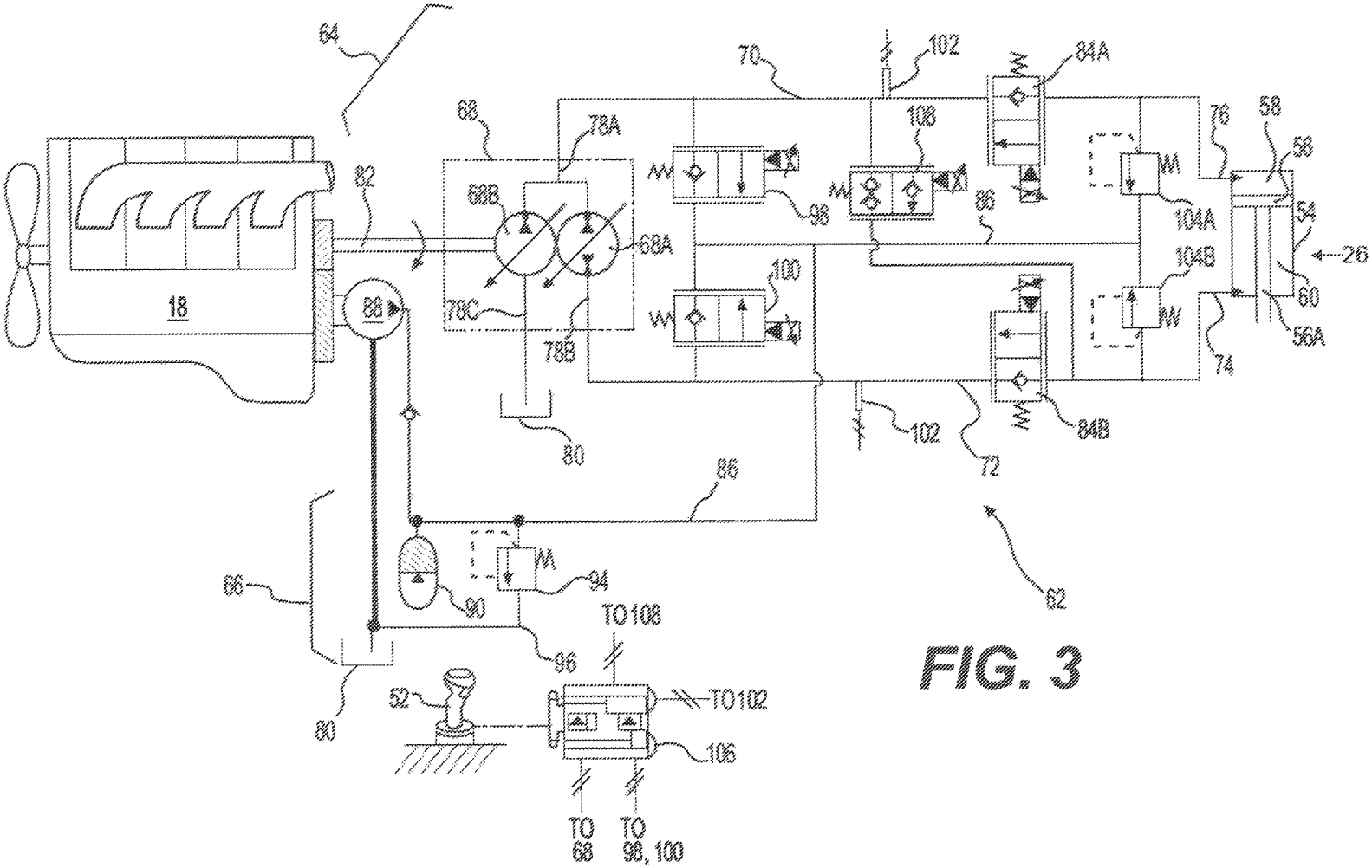

An alternative embodiment of hydraulic system 62 is illustrated in FIG. 3. Like the embodiment of FIG. 2, hydraulic system 62 of FIG. 3 my include a closed-loop tool circuit having first and second pump passages 70, 72 fluidly connecting pump 68 to rod- and head-end passages 74, 76 of hydraulic cylinder 26. Hydraulic system 62 of FIG. 3 may also include relief valves 104*a*, 104*b*, load-holding valves 84*a*, 84*b*, and damping control valves 98, 100, while also being fluidly connected to charge circuit 66 via common passage 86. However, in contrast to the embodiment of FIG. 2, hydraulic system 62 of FIG. 3 may include a regeneration control valve 108 that is configured to selectively allow fluid discharged from hydraulic cylinder 26 to flow from first pump passage 70 to rod-end passage 74. Regeneration control valve 108 may allow fluid from first chamber 58 to flow directly to second chamber 60, thereby reducing fluid flow through pump 68. As a result, pump 68 may be made smaller and more efficient.

Regeneration control valve 108 may be a two-position proportional solenoid-operated control valve that is fluidly connected between first passage 70 and rod-end passage 74. Regeneration control valve 108 may be spring-biased to remain in a first position for preventing flow between first and rod-end passages 70, 74. During retraction of hydraulic cylinder 26, regeneration control valve 108 may be moved to a second position and serve as a check valve to allow excess fluid to flow from first passage 70 to rod end passage 74, while preventing reverse flow.

When regeneration control valve 108 is open during retraction of cylinder 26, a change in the direction of the load on rod portion 56A may cause a change in the velocity of piston assembly 56. For example, when the load on rod portion 56A (e.g., the weight of the payload, weight of implement system 12, etc.) acts in the same direction as the velocity of piston assembly 56 (i.e., in the retracting direction), the load may be favorable to and assist the retraction of cylinder 26. This may allow fluid to be forced through the check valve associated with the second position of regeneration control valve 108 and into rod-end passage 74.

However, if the direction of the load changes (i.e., to act against the retraction of cylinder 26), the velocity of piston assembly 56 may be reduced, and the pressure in first passage 70 may decrease. When the direction of the load on rod portion 56A changes, as indicated by the pressure signal generated by sensors 102, regeneration control valve 108 may return to its first position. At about this same time, the displacements of pumping elements 68*a* and 68*b* may be adjusted to increase fluid flow into second passage 72 and increase the pressure in second chamber 60 to prevent the velocity of cylinder 26 from decreasing.

Regeneration control valve 108 may be sized to efficiently pass excess fluid from first passage 70 into rod-end passage 74 in order to allow some fluid to bypass pump 68 when the rod load compresses cylinder 26. For example, regeneration control valve 108 may be sized to pass the rod-end $V_{RE}$ volume of fluid exiting second chamber 58 directly into rod-end passage 74, leaving only the rod volume $V_R$ to be received by pump 68. In this way, the size of pump 68 may be reduced, thereby improving the efficiency of hydraulic system 62.

As shown in FIG. 3, regeneration control valve 108 may be fluidly connected to first passage 70 between pump 68 and load-holding valve 84*a*, and to rod-end passage 74 between load-holding valve 84*b* and hydraulic cylinder 26. In this way, load-holding valve 84*a* may prevent hydraulic cylinder from collapsing during a failure of regeneration control valve 108. In other embodiments, regeneration control valve may alternatively be fluidly connected to first passage 70 between load-holding valve 84*a* and hydraulic cylinder 26. In this way, fluid from hydraulic cylinder 26 may be removed from head end passage 76 before passing through load-holding valve 84*a*, which would allow load-holding valve 84*a* to be made smaller and more efficient. Other connecting arrangements of regeneration control valve 108 may be possible.

Figure 4:
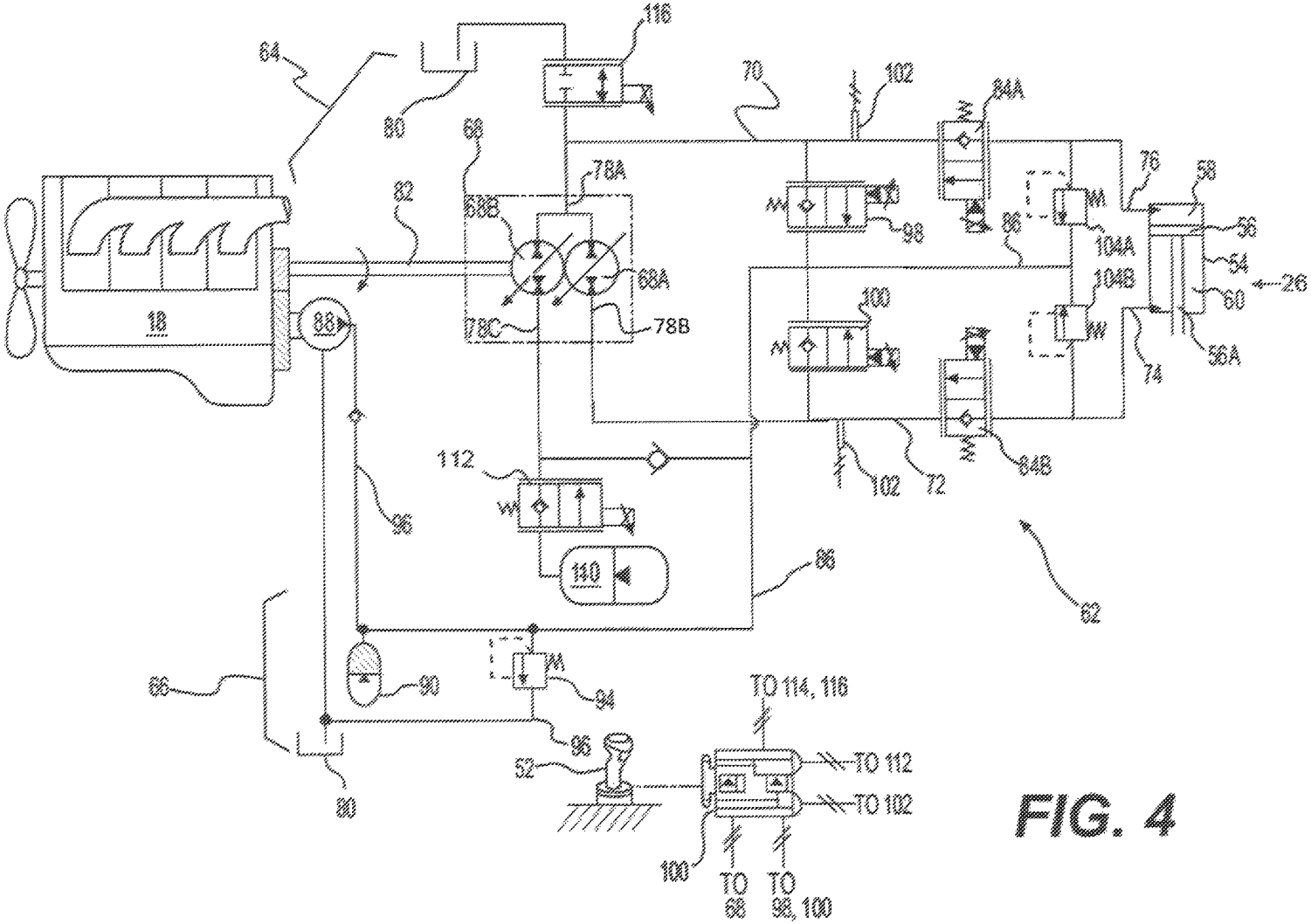

Another alternative embodiment of hydraulic system 62 is illustrated in FIG. 4. Like the embodiments of FIGS. 2 and 3, hydraulic system 62 of FIG. 4 may include a closed-loop tool circuit having first and second pump passages 70, 72 fluidly connecting pump 68 to rod- and head-end passages 74, 76 of hydraulic cylinder 26. Hydraulic system 62 of FIG. 4 may also include relief valves 104*a*, 104*b*, load-holding valves 84*a*, 84*b*, and damping control valves 98, 100, while also being fluidly connected to charge circuit 66 via common passage 86. Hydraulic system 62 of FIG. 4 may further include an accumulator 110 that is fluidly connected to pump 68 via a first discharge valve 112.

Accumulator 110 may be fluidly connected to exchange fluid with third port 78*c* of pump 68 via first discharge valve 112. Accumulator 110 may embody, for example, a compressed gas, membrane/spring, or bladder type of accumulator configured to accumulate and discharge pressurized fluid. First discharge valve 112 may be a two-way, solenoid-operated, proportional control valve that is spring-biased to reside in a first position, and movable to a second position. First discharge valve 112 may be configured to move between the first and second positions based on the signal from input device 52.

First discharge valve 112 may be in the first position whenever there is an inactive command from input device 52 (i.e., whenever input device 52 has not generated a signal), or an active command to retract cylinder 26. When in the first position, first discharge valve 112 may serve as a check valve to allow flow into accumulator 110 from third port 78*c* of pump 68 or common passage 86. For example, during retraction of hydraulic cylinder 26, all or a portion of the rod volume $V_R$ may pass from first passage 70, through pump 68, and into accumulator 110 via first discharge valve 112 in its first position. In this way, energy within the fluid may be stored inside accumulator 110 for future use instead of being discharged to low-pressure fluid source 80, where energy within the fluid may be transferred to shaft 82, which could then be lost to friction or compression losses in power source 18.

When first discharge valve 112 is in its second position, fluid may be allowed to flow freely from accumulator 110 into pump 68 and returned to first pump passage 70, thereby returning the rod volume $V_R$ to first chamber 58 during extension of hydraulic cylinder 26. In this way, the rod volume $V_R$ may be stored and returned at an elevated pressure, which may obviate the need to re-pressurize fluid to make up the rod volume $V_R$ each time hydraulic cylinder 26 is extended.

First discharge valve 112 may move to the second position whenever there is an active command from input device 52 to extend cylinder 26. In the second position, first discharge valve 112 may fluidly connect pump 68 to accumulator to allow unidirectional flow from accumulator 110 to pump 68. In this way, first discharge valve 112 may isolate accumulator 110 from pump 68 when hydraulic cylinder 26 is not being moved or is being retracted in order to prevent fluid within accumulator 110 from slowly leaking out through pump 68 or other components of hydraulic system 62.

First discharge valve 112 may also be moved to its second position during starting operations of power source 18. For example, when power source 18 is being started, first discharge valve 112 may be moved to its second position to allow pressurized fluid to flow from accumulator 110 into third port 78*c* of pump 68. First discharge valve 112 may be configured to move from the first position to the second position during starting operations of power source 18 based on a signal from controller 106 indicating that power source 18 is being started. That is, when power source 18 is not running and controller 106 sends a signal to first discharge valve 112 that indicates power source 18 is being started, first discharge valve 112 may be moved under solenoid force to its second position, thereby allowing fluid from accumulator 110 to flow into third port 78*c* of pump 68 to drive pump 68 to help start power source 18. In this way, pump 68 may operate as a motor to assist the starting of power source 18, thereby providing a reliable way to quickly start power source 18 after periods of being shut down to conserve fuel.

As seen in FIG. 4, hydraulic system 62 may also be equipped with a second discharge valve 116 that is fluidly connected between first port 78*a* of pump 68 and low-pressure fluid source 80. Second discharge valve 116 may be a solenoid-operated, proportional control valve that is spring biased to reside in a first position and movable to a second position. In its first position, second discharge valve 116 may prevent flow between pump 68 and low-pressure fluid source. In its second position, second discharge valve 116 may direct fluid from first port 78*a* of pump 68 to low-pressure fluid source 80.

For example, when controller 106 signals first discharge valve 112 to move to its second position (i.e., to allow fluid from accumulator 110 to flow into third port 78*c* of pump 68), controller 106 may also signal second discharge valve 116 to move to its second position. In its second position, second discharge valve 116 may allow fluid that was forced into pump 68 from accumulator 110 to be discharged to low-pressure fluid source 80 instead of into first pump passage 76. In this way, the energy from the accumulator is transferred via the motoring function of pump 68*b* to starting the engine.

In another embodiment, however, second discharge valve 116 may be omitted, and damping control valve 98 may be sized and operated to divert the fluid from the starting process into charge circuit 66 to charge accumulator 90 or be directed to tank 80 via relief valve 94. For example, when controller 106 signals first discharge valve 112 to move to its second position during a startup of power source 18 (i.e., to allow fluid from accumulator 110 to flow into third port 78*c* of pump 68), controller 106 may also signal damping control valve 98 to move to its second position and open its orifice to allow fluid from the starting process to enter charge circuit 66. In this way, at the cost of less cranking torque, the use of additional parts may be reduced, thereby lowering the cost to build hydraulic system 62.

Figure 5:
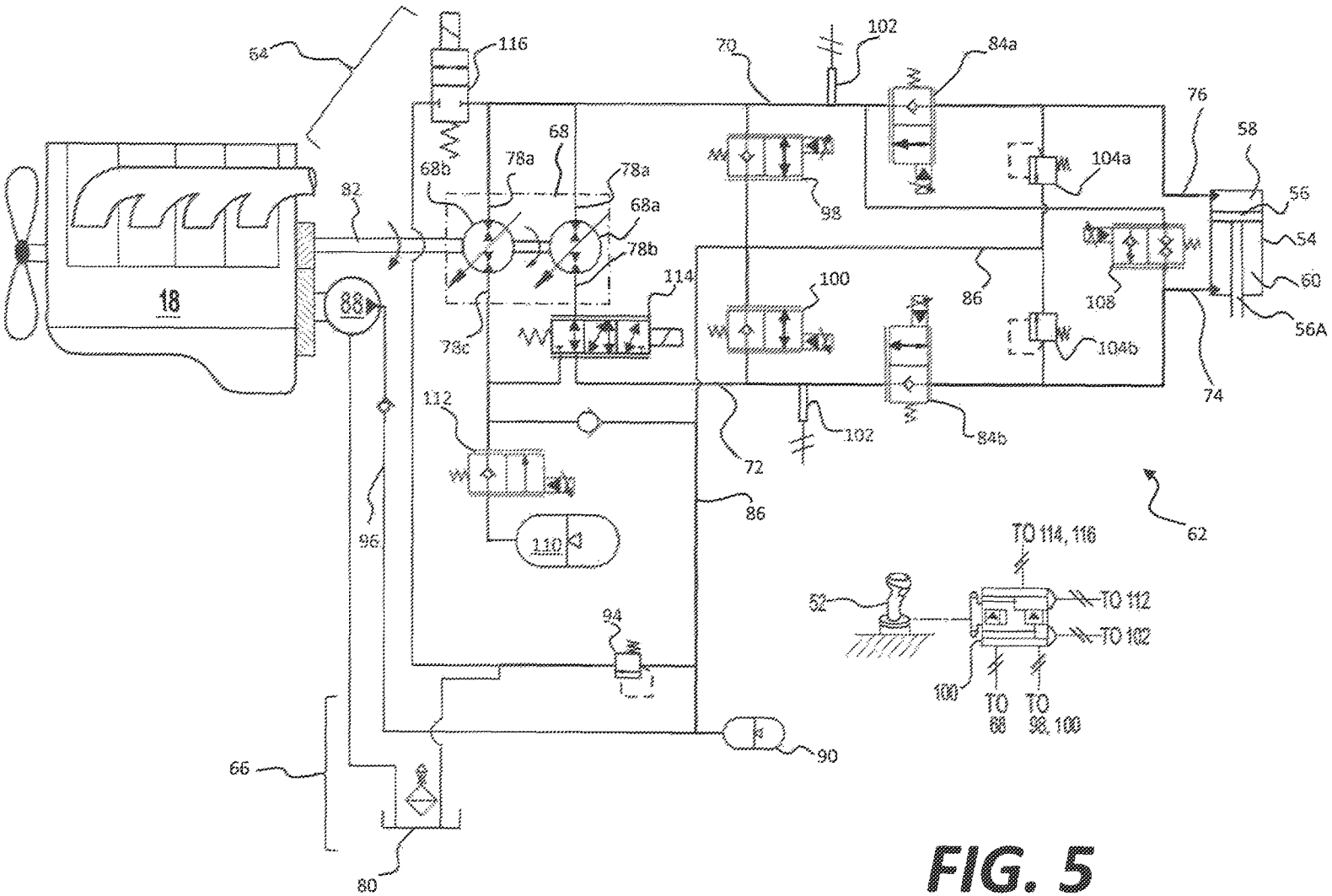

Another alternative embodiment of hydraulic system 62 is illustrated in FIG. 5. Like the embodiments of FIG. 4 hydraulic system 62 of FIG. 5 may include a closed-loop tool circuit having first and second pump passages 70, 72 fluidly connecting pump 68 to rod- and head-end passages 74, 76 of hydraulic cylinder 26. Hydraulic system 62 of FIG. 5 may also include relief valves 104*a*, 104*b*, load-holding valves 84*a*, 84*b*, and damping control valves 98, 100, while also being fluidly connected to charge circuit 66 via common passage 86. Hydraulic system 62 of FIG. 5 may also include an accumulator 110 that is fluidly connected to pump 68 via a first discharge valve 112. Hydraulic system 62 may further include a three way valve 114 that is configured to selectively connect second port 78*b* of pump 68 to second pump passage 72 or to accumulator 110 via discharge valve 112 based on a signal from controller 106. Hydraulic system 62 of FIG. 5 may also include regeneration control valve 108. Regeneration control valve may selectively allow fluid to pass from first pump passage 70 to rod-end passage 74 based on a signal from controller 106.

Three way valve 114 may be configured to selectively connect second port 78*b* of pump 68 to second pump passage 72 or to accumulator 110 via discharge valve 112. Three way valve 114 may be three position, solenoid-operated, proportional control valve that is spring biased to a first position and electronically connected to controller 106. Three way valve 114 may be moved to any of its three positions based on signal received from controller 106. In the first position, three way valve 114 may allow fluid to flow between second port 78*b* and second pump passage 72, while preventing flow between second port 78*b* and accumulator 110. In a second position, three way valve 114 may allow fluid to flow between second port 78*b* and second pump passage 72 while also allowing flow between second port 78*b* and accumulator 110. In a third position, three way valve 114 may prevent flow between second port 78*b* and second pump passage 72, while allowing flow between second port 78*b* and accumulator 110.

INDUSTRIAL APPLICABILITY

The disclosed hydraulic system may be applicable to any machine where improved hydraulic efficiency and control is desired. The disclosed hydraulic system may provide for improved efficiency through the use of meterless technology. Particularly, the disclosed hydraulic system may provide for more efficient movement of fluid between head- and rod-ends of a hydraulic cylinder, while reducing pressure oscillations between the cylinder and a pump. Further, the disclosed hydraulic system may provide for more efficient starting of the power source that drives the hydraulic system. Operation of hydraulic system 62 will now be described.

To operate machine 10, an operator located within station 20 may first start power source 18. The operator may turn a key, press a button, or otherwise indicate a desire to start power source 18, and controller 106 may generate a signal to move first discharge valve 112 (referring to FIGS. 4-5) and second discharge valve 116 to their second positions, respectively. In this way, pressurized fluid from accumulator 110 may pass through first discharge valve 112 into third port 78*c* of pump 68 to drive second pumping element 68*b* like a motor to start power source 18. At this same time three way valve 114 (referring to FIG. 5) could be energized and pump 68A stroked to allow flow from accumulator 110 through pump 68A thereby assisting pump 68B at cranking the engine to start. Second discharge valve 116 may also be in its second position during this time to allow fluid exiting pump 68 via first port 78*a* to pass into low-pressure fluid source 80.

Once power source 18 is running, the operator may displace input device 52 in a particular direction by a particular amount and/or with a particular speed to command motion of work tool 14 in a desired direction, at a desired velocity, and/or with a desired force. One or more corresponding signals generated by input device 52 may be provided to controller 106 to indicate the desired motion, along with machine performance information. Such performance information may include, for example, sensor data, such a pressure data from pressure sensors 102, position data, speed data, pump or motor displacement data, and other data known in the art.

In response to the signals from input device 52, such as a signal indicative of a desire to lift work tool 14, and based on the machine performance information, controller 106 may generate control signals directed to the stroke-adjusting mechanism of pump 68 within tool circuit 64 and/or to damping control valves 98, 100. These control signals may include a first control signal that causes pump 68 to increase its displacement and discharge pressurized fluid into first pump passage 70 at a greater rate. When fluid from pump 68 is directed into first chamber 58 via first port 78*a* and first pump passage 70, return fluid from second chamber 60 of hydraulic cylinders 26 may flow back to pump 68 via second pump passages 72 and second port 78*b* in closed-loop manner. Controller 106 may generate a signal to move load holding valve 84*b* to its second position to allow fluid to exit second chamber 60 and flow toward pump 68. At this time, the pressure of fluid within first pump passage 70 may be greater than the pressure of fluid within second pump passage 72.

At this same time, pump 68 may draw fluid from accumulator to prevent pump 68 from starving for fluid. Pump 68 may draw the rod-end volume $V_{RE}$ from second chamber 60 and the rod volume $V_R$ from accumulator 110 so the rod volume $V_R$ and the rod-end volume $V_{RE}$ may combine to make up the head-end volume $V_{HE}$ to fill first chamber 58 without starving pump 68. Three way valve 114 (referring to FIG. 5) may be in its first position at this time to allow the rod-end volume $V_{RE}$ to flow from second pump passage into pumping element 68*a*, while the rod volume $V_R$ flows into pumping element 68*b* from accumulator 110. Makeup fluid may be drawn into pump 68 from charge circuit 66 as needed during extension of cylinder 26.

At this same time, controller 106 may determine the pressure within first pump passage 70 from data received from sensor 102 and adjust a restrictive orifice within damping control valve 98 based on the pressure data. Controller 106 may signal damping control valve 98 to open its orifice wider as the pressure within first pump passage 70 increases, and decrease the size of its orifice as the pressure within first pump passage 70 decreases. In this way, pressure oscillations between hydraulic cylinder 26 and pump 68 may be reduced, thereby preventing jerky operation of hydraulic system 62.

At about this same time, a control signal may be sent to damping control valve 96, causing damping control valve 98 to move to a position corresponding to the displacement of input device 52. For example, if input device 52 is displaced by only a small amount (i.e. directing more fluid to charge circuit 66), the orifice within damping control valve 98 may be widened nearly or all the way to its wide open position, at which a large amount of fluid from first pump passage 70 may bypass hydraulic cylinder 26 and flow into charge circuit 66 via common passage 86. In this situation, hydraulic cylinder 26 may be extending relatively slowly and/or with relatively little force. The extension may continue until work tool 14 becomes more heavily loaded or engages an immovable mass, at which time work tool 14 may stop moving and all of the fluid from first pump passage 70 may be forced to bypass hydraulic cylinder 26 and flow into charge circuit 66 via common passage 86.

However, when input device 52 is displaced by a greater amount (e.g., moved further after work tool has been stopped), the orifice within damping control valve 98 may be caused by controller 106 to be decreased in size so that a lesser amount of fluid from first pump passage 70 may bypass hydraulic cylinder 26 and flow into charge circuit 66 via common passage 86. In this situation, hydraulic cylinder 26 may extend more quickly and/or with greater force, as more fluid will be directed into hydraulic cylinder 26. In this manner, the operator may be provided with force control over hydraulic cylinder 26. Force modulation of other actuators within hydraulic system 62 may be regulated in a similar manner.

When the operator displaces input device 52 in the opposite direction (e.g., to collapse hydraulic cylinder 26), pump 68 may begin to draw fluid from first chamber 58 via first pump passage 70 and first port 78*a*, and discharge fluid into second chamber 60 via second port 78*b* and second pump passage 72. Controller 106 may then return load hold valve 84*b* to its first position (i.e., its check valve position) and move load hold valve 84*a* to its second position its flow passing position).

When the load on cylinder 26 is a favorable load (i.e., when the load applies a force on cylinder 26 that acts in the direction of travel of piston assembly 56), the pressure in first pump passage 70 may be greater than the pressure in second pump passage 72. Thus, when the load is favorable during retraction, controller 106 may generate a signal to move regeneration control valve 108 to its flow passing position to allow fluid to be forced from first pump passage 70 into rod-end passage 74. In this way, the rod-end volume $V_{RE}$ may be passed directly into second passage 60 with the assistance of the favorable load, thereby reducing the amount of fluid passing through pump 68.

The rod volume $V_R$ may continue to be forced into pump 68 and may reduce the load on pump 68, and hence, may also reduce the load on power source 18. That is, as the rod fluid is forced into pump 68, it may be forced in the same direction that pump is being driven, which may allow power source to apply a smaller force on pump 68 and consume less fuel. In this way, power source 18 may be able to dedicate more power to other tasks. Additionally, the displacements of pumping elements 68*a* and 68*b* may be reduced since a smaller amount of fluid may be forced through pump 68 during cylinder retraction.

At this same time, controller 106 may move three way valve to its third position to allow the rod volume $V_R$ from first pump passage 70 to flow toward accumulator 110 while blocking flow into second pump passage. The rod volume $V_R$ may pass through three way valve 114 and be forced through the check valve portion of discharge valve 112 in order to be stored in accumulator 110. In this way, pressurized fluid may be available to be returned to pump 68 the next time cylinder 26 is extended.

When the load inverts during retraction of cylinder 26 (i.e., when the load generates a force on cylinder 26 that acts against or resists the retraction of cylinder 26), the force provided by the favorable load may be reduced, and a greater amount of force may be required to act on piston assembly 56 in order to retract cylinder 26 at the desired velocity. At this time, the pressure of fluid within second pump passage 72 may be greater than the pressure of fluid within first pump passage 70, and controller 106 may return 3-way valve 114 and regeneration control valve 108 to their first positions thereby forcing the piston assembly 56 to move with fluid discharged from pump 68*a*.

At this time, the displacement of pumping element 68*a* may be adjusted to increase the amount of fluid being pumped into second pump passage since fluid from regeneration control valve 108 is no longer available. That is, the remaining rod-end volume $V_{RE}$ may be pumped entirely through second pump passage 72 and into rod-end passage 74 to continue collapsing cylinder 26.

The disclosed hydraulic system may provide for more efficient transfer of fluid from first chamber 58 to second chamber 60 of hydraulic cylinder 26. In particular, the three-port configuration of pump 68 may allow the head-end volume $V_{HE}$ of cylinder 26 to be separated into the rod-end volume $V_{RE}$ and the rod volume $V_R$ so the rod-end volume $V_{RE}$ may be passed to second chamber 60 and the rod volume $V_R$ may be stored in accumulator 110. In this way, the rod volume $V_R$ may be withdrawn and returned into first pump passage 70 via third port 78*c* of pump 68, thereby assisting power source 18 to perform this and other tasks. Accumulator 110 may also provide energy storage for helping to start power source 18, thereby enabling fuel conservation during idle periods of machine 10.

Further, damping control valves 98, 100 may help to reduce pressure oscillations between cylinder 26 and pump 68 from causing jerky operations, while also performing force modulation and check valve function. In this way, damping control valves 98, 100 may improve the feel and control of operating machine 10, while decreasing the cost of manufacturing hydraulic system 62. Additionally, regeneration control valve 108 may allow excess head-end fluid to pass from first pump passage 70 to rod-end passage 74 when cylinder 26 is retracting and the load on rod portion 56A acts in the same direction as the velocity of piston assembly 56, thereby minimizing the size of pumping elements 68*a* and 68*b* of pump 68 when the retraction velocity is greater than the extension velocity.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:

an accumulator as a fluid source;

an actuator having a first passage and a second passage;

a pump having a single pumping element, a first port connected to the first passage, a second port connected to the second passage, and a third port connected to the accumulator, wherein the first and second passages are connected to each other via the first and second ports, and the first passage and the accumulator are connected to each other via the first and third ports;

a charge circuit fluidly connected to the first and second passages;

a pair of damping control valves respectively connected to the first passage and the second passage, each of the damping control valves being configured to selectively allow fluid from the pump to pass into the charge circuit to dampen pressure oscillations between the actuator and the pump;

a first discharge valve fluidly connected between the third port of the pump and the accumulator;

a second discharge valve fluidly connected between the first port of the pump and a low-pressure fluid source;

a pair of pressure relief valves respectively connected to the first passage and the second passage;

a common passage fluidly connected to an output of the first discharge valve, to the third port, between the pair of damping control valves, between the pair of pressure relief valves, and to the charge circuit; and a three way valve configured to selectively connect the second port of the pump to the accumulator via the first discharge valve or to the second passage.

2. The hydraulic system of claim 1, wherein:

each said damping control valve of the pair of damping control valves includes a variable restrictive orifice;

the hydraulic system further comprises a controller in communication with the pair of damping control valves; and the controller is configured to selectively adjust the variable restrictive orifice of each of the damping control valves of the pair of damping control valves to vary a damping effect based on a pressure between the actuator and the pump.

3. The hydraulic system of claim 2, wherein:

the hydraulic system further comprises an input device in communication with the controller and configured to generate a signal indicative of a desire to move the actuator; and the controller is further configured to selectively adjust the variable restrictive orifice of each of the damping control valves of the pair of damping control valves to divert fluid from the pump into the charge circuit to modulate a force of the actuator based on the signal from the input device.

4. The hydraulic system of claim 3, wherein each of the damping control valves of the pair of damping control valves is movable from a first position at which fluid is allowed to flow into the charge circuit, to a second position at which makeup fluid is allowed to pass into one of the first and second passages based on a pressure.

5. The hydraulic system of claim 1, further comprising a regeneration control valve configured to selectively allow fluid expelled from the actuator to pass from the first passage into the second passage when the actuator is retracted, the regeneration control valve being connected directly to the actuator.

6. The hydraulic system of claim 5, wherein the first discharge valve is selectively moveable to:

a first position at which fluid is allowed to pass into the accumulator based on a pressure; and a second position at which fluid is allowed to pass into the third port of the pump from the accumulator.

7. A method of operating a hydraulic system, comprising:

receiving a signal indicative of a desire to move a work tool via an actuator;

drawing fluid into a pump having a single pumping element, a first port connected to a first passage, a second port connected to a second passage, and a third port connected to an accumulator as a fluid source, the first port being in communication with a first passage fluidly connected to the actuator, the second port being in communication with the second passage fluidly connected to the actuator, and the third port being in communication with the accumulator, and discharging pressurized fluid from the pump into at least one of the other of the first and second passages and the accumulator to move the actuator based on the signal; and selectively directing pressurized fluid from the pump through one of the first, second, and third ports, and a pair of damping control valves respectively connected to the first passage and the second passage, to a charge circuit to dampen fluid pressure oscillations between the pump and the actuator, wherein said selectively directing pressurized fluid from the pump to the charge circuit includes:

determining a pressure in the first passage with a controller using data from a sensor and adjusting with the controller a variable restrictive orifice based on the data that is indicative of a pressure differential between the actuator and the pump, further including increasing dampening of the fluid pressure oscillations by increasing a size of the variable restrictive orifice under control of the controller when the pressure differential between the actuator and the pump increases, and selectively diverting fluid from the pump into the charge circuit to modulate a force of the actuator based on the signal, wherein the hydraulic system includes:

a first discharge valve fluidly connected between the third port of the pump and the accumulator, a second discharge valve fluidly connected between the first port of the pump and a low-pressure fluid source, a pair of pressure relief valves respectively connected to the first passage and the second passage, a common passage being fluidly connected to an output of the first discharge valve, to the third port, between the pair of damping control valves, between the pair of pressure relief valves, and to the charge circuit, and a regeneration control valve configured to selectively allow fluid expelled from the actuator to pass from the first passage into the second passage when the actuator is retracted, the regeneration control valve having one input connected directly to the actuator and another input connected directly to the second discharge valve and the first port.

8. The method of claim 7, further comprising selectively allowing fluid from the first passage to bypass the pump and flow into the second passage when the actuator is retracting.

9. The method of claim 7, further comprising accumulating fluid from the pump when the actuator is retracting.

10. The method of claim 9, further comprising selectively directing accumulated fluid to the pump to drive the pump.

11. The method of claim 9, further comprising selectively directing fluid from the pump to one of the charge circuit and the low-pressure fluid source.

12. A hydraulic system, comprising:

an accumulator;

an actuator having a first passage and a second passage;

a pump having a first port connected to the first passage, a second port connected to the second passage, and a third port connected to the accumulator, wherein the first and second passages are connected to each other via the first and second ports, and the first passage and the low-pressure fluid source are connected to each other via the first and third ports;

a charge circuit fluidly connected to the first and second passages;

at least one damping control valve configured to selectively allow fluid from the pump to pass into the charge circuit to dampen pressure oscillations between the actuator and the pump;

a regeneration control valve configured to selectively allow fluid expelled from the actuator into the first passage to bypass the pump and flow into the second passage when the actuator is retracted;

a discharge valve fluidly connected between the pump and the accumulator; and a three way valve configured to selectively connect the second port of the pump to the accumulator via the discharge valve or to the second passage.

* * * * *